US008684512B2

(12) United States Patent
Nakazawa et al.

(10) Patent No.: US 8,684,512 B2
(45) Date of Patent: Apr. 1, 2014

(54) INK DRYING APPARATUS AND INK-JET PRINTING APPARATUS

(75) Inventors: Takashi Nakazawa, Hachioji (JP); Yoshimasa Araki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 71 days.

(21) Appl. No.: 13/319,605

(22) PCT Filed: May 25, 2010

(86) PCT No.: PCT/JP2010/003495

§ 371 (c)(1), (2), (4) Date: Nov. 9, 2011

(87) PCT Pub. No.: WO2010/137299

PCT Pub. Date: Dec. 2, 2010

(65) Prior Publication Data

US 2012/0069110 A1 Mar. 22, 2012

(30) Foreign Application Priority Data

May 28, 2009 (JP) ..... 2009-129209

(51) Int. Cl.
*B41J 2/01* (2006.01)
*B41J 29/38* (2006.01)

(52) U.S. Cl.
USPC ..... 347/102; 347/6

(58) Field of Classification Search
None
See application file for complete search history.

(56) References Cited

U.S. PATENT DOCUMENTS

| | | | | |
|---|---|---|---|---|
| 7,182,454 | B2 | 2/2007 | Nakazawa | |
| 2004/0046850 | A1 * | 3/2004 | Domoto et al. | 347/102 |
| 2006/0001721 | A1 | 1/2006 | Yraceburu et al. | |
| 2008/0158324 | A1 * | 7/2008 | Yraceburu et al. | 347/102 |

FOREIGN PATENT DOCUMENTS

| | | | |
|---|---|---|---|
| EP | 1442892 | B1 | 10/2009 |
| JP | 5-338126 | A | 12/1993 |
| JP | 2004-230709 | A | 8/2004 |
| JP | 2006-095774 | A | 4/2006 |
| JP | 2008-302641 | A | 12/2008 |
| JP | 2009-029009 | A | 2/2009 |

OTHER PUBLICATIONS

International Preliminary Report on Patentability, International Application No. PCT/JP2010/003495, filed on May 25, 2010.
Office Action dated Apr. 23, 2013, in Japanese Application No. 2009-129209.

* cited by examiner

*Primary Examiner* — Stephen Meier
*Assistant Examiner* — Alexander C Witkowski
(74) *Attorney, Agent, or Firm* — Fitzpatrick, Cella, Harper & Scinto

(57) ABSTRACT

An ink drying apparatus is provided with a gas passage through which a printed material to which ink is attached passes. Further, a flow applying unit configured to create a flow of gas in the gas passage in a predetermined direction, a heating unit configured to heat the gas in the gas passage, and a solvent removing unit configured to remove a solvent in the ink from the gas passage are provided. In the ink drying apparatus, the heating unit and the solvent removing unit are associated with each other such that heat can transfer from the solvent removing unit to the heating unit by a heat transmission unit.

5 Claims, 5 Drawing Sheets

INK DRYING APPARATUS AND INK-JET PRINTING APPARATUS

TECHNICAL FIELD

The present invention relates to a technology of an ink drying apparatus suitably used for an ink-jet printing apparatus.

BACKGROUND ART

An ink-jet printing apparatus ejects ink (print liquids) droplets from an ejection opening of a print head to be attached on a printed material, thus printing an image thereon. Since the ink droplet contains a solvent such as water or an organic solvent, removal of the solvent is performed from the ink for settling the ink on the printed material. For removing the solvent from the ink, for example, a heater is used.

An image forming device disclosed in Patent Literature 1 is provided with a drying unit including a drying heater which heats a print paper to vaporize the solvent in the ink, a water component collecting device for collecting the vaporized solvent, and a collecting tank for reserving the collected solvent. The water component collecting device is a compressor type dehumidification system or a desiccant dehumidification system.

CITATION LIST

Patent Literature

[PTL 1] Japanese Patent Laid-Open No. 2006-95774

SUMMARY OF INVENTION

Technical Problem

In drying the ink, it is desirable that separation or removal of the solvent is carried out with lower energy. However, the drying heater and the water component collecting device are arranged separately and independently in the drying unit of Patent Literature 1. Therefore, an operation of the drying heater and an operation of the water component drying device, respectively, are performed independently. In consequence, the device of Patent Literature 1 is disadvantageous in view of energy efficiency.

The present invention is made in view of the forgoing problem and an object of the present invention is to enhance the energy efficiency in regard to drying ink of a printed material.

Solution to Problem

An ink drying apparatus according to the present invention comprises a gas passage, a flow applying unit configured to flow a gas in the gas passage in a predetermined direction, a heating unit configured to heat the gas in the gas passage, and a solvent removing unit configured to remove a solvent in ink from the gas passage. The heating unit and the solvent removing unit are associated with each other such that heat can transfer from the solvent removing unit to the heating unit by a heat transmission unit.

Advantageous Effects of Invention

According to the present invention, the heating unit configured to heat the gas in the gas passage through which the printed material to which the ink is attached passes and the solvent removing unit configured to remove the solvent of the ink from the gas passage are associated with each other such that the heat can transfer therebetween. In consequence, according to the present invention, it is possible to enhance the energy efficiency in regard to drying the ink of the printed material.

DESCRIPTION OF EMBODIMENTS

<First Embodiment>

Figure 1:
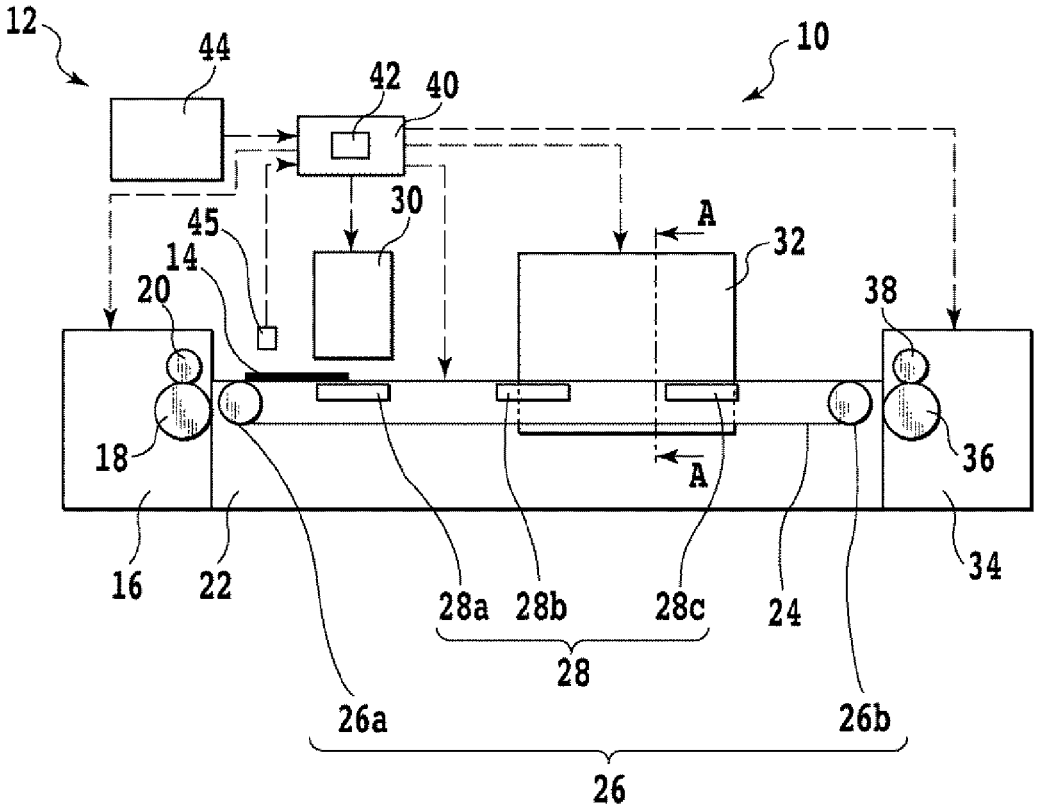
FIG. 1 is a schematic diagram showing an entire arrangement of an ink-jet printing apparatus to which an ink drying apparatus of a first embodiment is applied.

FIG. 1 is a schematic diagram showing an entire arrangement of an ink-jet printing apparatus 12 to which an ink drying apparatus 10 in the first embodiment is applied. In the ink-jet printing apparatus (hereinafter, refer to printing apparatus) 12, a printed material 14 is supplied from a supplying unit 16. The supplying unit 16 includes a drive roller 18 and a driven roller 20 and supplies the printed material 14 such as a paper to a carrying unit 22 through between them. The printed material 14 supplied by the supplying unit 16 is set on a carrying belt 24 of the carrying unit 22 and moves inside the printing apparatus 12 by the movement of the carrying belt 24.

The carrying unit 22 is provided with the carrying belt 24 as an endless belt, carrying rollers 26 (26*a* and 26*b*) for moving the carrying belt 24 in a given direction and retaining devices 28 (28*a*, 28*b* and 28*c*) for retaining the printed material 14 on the carrying belt 24. The retaining devices 28 are substantially positioned inside the carrying belt 24 wound around and between the carrying rollers 26*a* and 26*b*. The retaining devices 28 include a fan and the like, and can maintain planarity of the printed material 14 on the carrying belt 24 by using a vacuum. When power of a motor (not shown) is transmitted to the carrying roller 26 around which the carrying belt 24 is wound, the carrying belt 24 is driven in a clockwise direction in FIG. 1. As a result, the printed material 14 retained on the carrying belt 24 is carried from left to right in FIG. 1, and fed to a printing unit 30, a drying unit 32 and a discharging unit 34 in that order. It should be noted that the carrying unit 22 is hereby configured by adopting a belt carrying system, but is not limited thereto and other forms such as a drum carrying system may be applied.

The printing unit 30 includes a printing component having a plurality of print heads for ejecting ink of each color of black, cyan, magenta and yellow and an ink storing/filling unit for storing ink supplied to each print head. The printing unit 30 ejects ink on the printed material 14 which is placed and carried on the carrying belt 24 and attaches the ink thereon. It should be noted that, for appropriately performing the attachment of the ink on the printed material 14, the retaining device 28*a* is provided in a position opposing the printing unit 30.

When the printed material 14 which has passed through the printing unit 30 is fed to the drying unit 32, the drying of the ink on the printed material 14 is promoted at the drying unit 32 in the ink drying apparatus 10. The printed material 14 which has passed through the drying unit 32 is fed to the discharging unit 34 for discharging. The discharging unit 34 is provided with a discharge drive roller 36 and a discharge driven roller 38.

Figure 2:
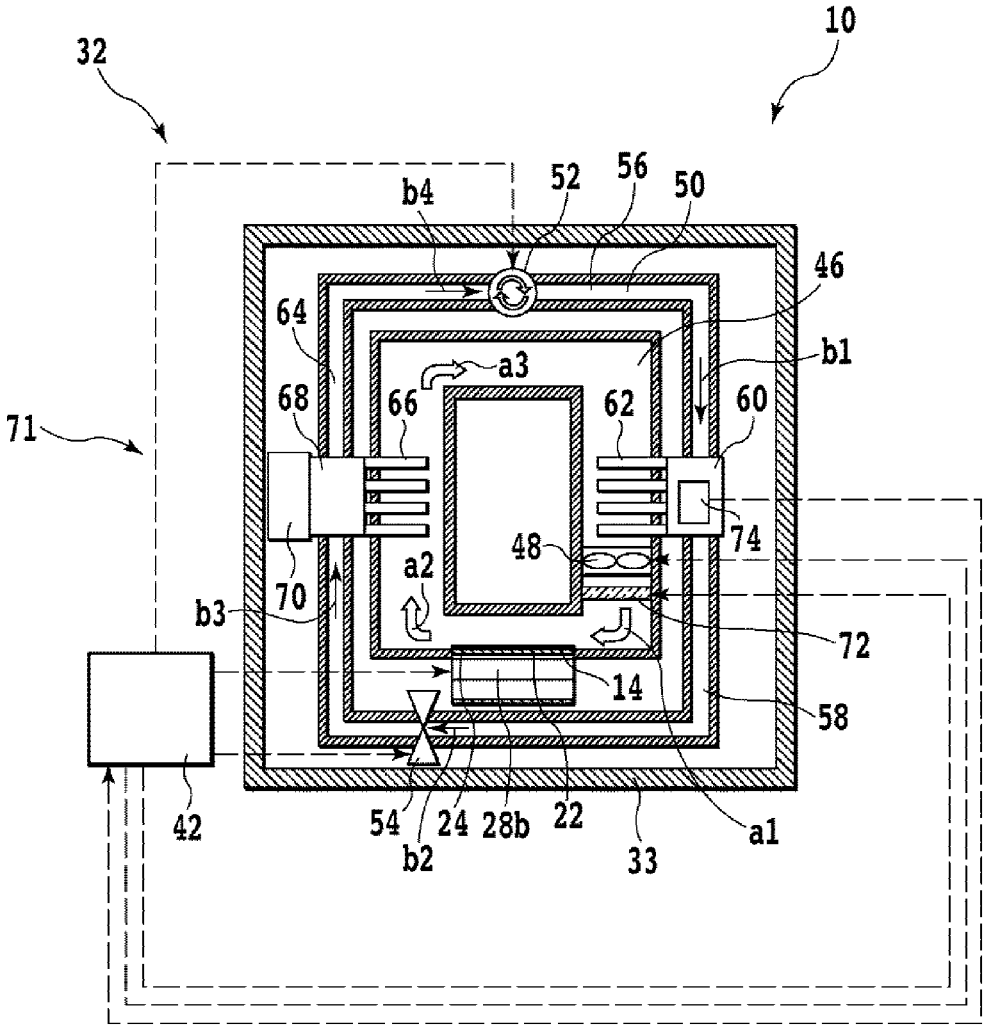
FIG. 2 is schematically a cross-sectional diagram taken along line A-A in FIG. 1 and is a cross-sectional diagram of the ink drying apparatus.

Next, a detail of the ink drying apparatus 10 will be explained. FIG. 2 is a cross-sectional diagram taken along line A-A in FIG. 1 and is a cross-sectional diagram of the ink drying apparatus 10. The ink drying apparatus 10 is provided for drying the ink on the printed material 14. The ink drying apparatus 10 is provided with the above drying unit 32. For controlling an operation of the drying unit 32, the ink drying apparatus 10 is configured by including a part (control device 42 as dry control unit) of a control device 40. The control device 40 is configured by a microcomputer including a CPU, a ROM, a RAM, an A/D converter, an input interface, an output interface and the like. Various sensors and a transmitting unit 44 for transmitting data from an input unit to which a user can input an instruction are connected electrically to the input interface. The various sensors include an infrared moisture component meter 45 as a water component amount detecting device. Based upon output signals from the various sensors and the transmitting unit 44, the control device 40 controls an operation of the drying unit 32, as well as operations of the supplying unit 16, the carrying unit 22, the printing unit 30, and the discharging unit 34 according preset programs and the like.

The drying unit 32 in the ink drying apparatus 10 is configured by including a part of the carrying unit 22. The part of the carrying unit 22 included in the ink drying apparatus 10 is a portion of the carrying unit 22 corresponding to a carrying mechanism unit carrying the printed material 14 to the drying unit 32 and making the printed material 14 pass through the drying unit 32 and a retaining mechanism unit retaining the printed material 14 in the drying unit 32 not to curl therein. Specifically the carrying mechanism unit includes the carrying belt 24 and the carrying roller 26 in the carrying unit 22, and the retaining mechanism unit includes the retaining devices 28*b* and 28*c*. Therefore, the retaining devices 28*b* and 28*c* are positioned in regard to the drying unit 32. It should be noted that the carrying mechanism unit and the retaining mechanism unit independent from the carrying unit 22 may be provided.

The printed material 14 on which ink is attached is fed in a case member 33 of the drying unit 32. The printed material 14 is led to a gas passage 46 through which a drying gas such as air passes. The carrying unit 22 and the drying unit 32 are associated with each other such that the printed material 14 passes through the gas passage 46. The gas passage 46 is circularly defined by the case member 33 and is configured such that the gas can be re-circulated in the gas passage 46. A blower fan 48 as the flow applying unit is provided to form a flow of the gas such that the gas in the gas passage 46 flows in a predetermined direction for re-circulation. The gas is oriented in such a manner that the gas is re-circulated in a clockwise direction in FIG. 2. In FIG. 2, the flow of the gas is conceptually shown by arrows a1, a2 and a3. It should be noted that the gas passage 46 may be not necessarily circular.

Figure 3:
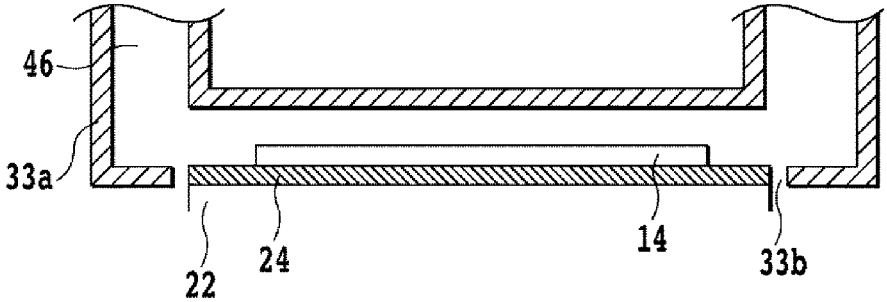
FIG. 3 is schematically a partially enlarged diagram in the periphery of a carrying unit in FIG. 2.

As shown in the partially enlarged diagram, in FIG. 3, in the periphery of the carrying unit 22 in FIG. 2, a space portion 33*b* slightly larger than a width of the carrying unit 22 exists in a portion 33*a* of the case member 33 defining the gas passage 46. This is to prevent sliding contact between the carrying unit 22 and the case member 33. However, a clearance between the carrying unit 22 and the case member 33 is preferably adjusted to the minimum limit such that the gas can be appropriately recirculated in the gas passage 46.

The drying unit 32 is provided with a heat pump device 56 having a circular coolant passage 50 in which a coolant flows, a compressor 52 for compressing the coolant in such a manner as to generate a pressure difference in the coolant, and an expansion valve 54 as an expansion mechanism unit for depressurizing the coolant. The coolant passage 50 is provided with the compressor 52 and the expansion valve 54. The coolant passage 50 in the heat pump device 56 is provided adjacent to the gas passage 46, which, as described later, enables heat exchange between the coolant of the heat pump device 56 and the gas in the gas passage 46. The coolant can be re-circulated in the coolant passage 50 to flow in a clockwise direction in FIG. 2, and in FIG. 2, the flow of the coolant is conceptually shown by arrows b1, b2, b3 and b4.

A radiator 60 is arranged in the coolant passage 50 in the heat pump device 56 for heating the gas in the gas passage 46. The radiator 60 is provided in a first coolant passage 58 of the coolant passage 50 in which the coolant flows from the compressor 52 toward the expansion valve 54. A plurality of first fins 62 as a part of the radiator 60 extend into the gas passage 46. Accordingly, the radiator 60 enables heat exchange between the high-temperature coolant in the first coolant passage 58 and the gas in the gas passage 46. This causes the gas in the gas passage 46 to be heated. Therefore, the heating unit configured to heat the drying gas in the gas passage 46 is configured by including the radiator 60, the first coolant passage 58 containing the coolant, and the compressor 52. The coolant is cooled by passing through the radiator 60 to be a low-temperature coolant.

Further, an endothermic device 68 is arranged in the coolant passage 50 in the heat pump device 56 for cooling the gas in the gas passage 46. The endothermic device 68 having a plurality of second fins 66 extending into the gas passage 46 is provided in a second coolant passage 64 of the coolant passage 50 in which the coolant flows from the expansion valve 54 toward the compressor 52. Accordingly, the endothermic device 68 enables heat exchange between the low-temperature coolant in the second coolant passage 64 and the gas in the gas passage 46. Thereby the gas in the gas passage 46 which has passed the first fins 62 and further on the carrying belt 24 can be cooled. In consequence, the solvent in the ink contained in the gas on the second fins 66 of the endothermic device 68 and/or in the periphery thereof can be condensed. Therefore, the cooling unit configured to cool the gas in the gas passage 46 is configured by including the endothermic device 68, the second coolant passage 64 containing the coolant and the expansion valve 54. On the other hand, the coolant can be heated by passing through the endothermic device 68. As the coolant used in the heat pump device 56, the coolant which can change from gas to liquid in the radiator 60 and from liquid to gas in the endothermic device 68, for example, R134a coolant may be used.

Further, the drying unit 32 is provided with a solvent discharging device 70 as solvent discharging unit configured to be able to discharge the solvent in the ink from the gas passage 46. The solvent discharging device 70 includes, although not shown, fine bores each extending into the second fins 66 and one end of which is opened to the gas passage 46, and an absorption unit to which the other end is opened. An absorbing element which can absorb the solvent in the ink is arranged in the absorption unit. The absorption unit is opened to an outside of the printing apparatus 12. The solvent discharging device 70 as the solvent discharging unit and the cooling unit are included in the solvent removing unit 71 configured to remove the solvent in the ink from the gas passage 46 and are herein integrally formed. It should be noted that the solvent discharging device 70 may be omitted. In a case where the solvent discharging device 70 is not provided, a discharge passage of the solvent may be provided in the case member 33 such that the solvent of the ink condensed by a cooling function of the cooling unit flows out of the gas passage 46.

The gas passage 46 in the drying unit 32 is provided with a heater 72 as second heating unit configured to be able to heat the gas in the gas passage 46. The heater 72 is provided downstream of the blower fan 48 in such a manner as to heat the gas in the gas passage 46 flowing toward the printed material 14, but may be provided in the other location. The heater 72 is provided, as described later, to assist in an operation of the heat pump device 56. For making a determination on the necessity of the assistance by the heater 72, a temperature sensor 74 is provided in the heat pump device 56. Here, the temperature sensor 74 is provided in the radiator 60, but may be provided in the endothermic device 68 or the coolant passage 50.

An operation of the ink drying apparatus 10 including the retaining devices 28*b* and 28*c*, the compressor 52 and the expansion valve 54 in addition to the heater 72 is controlled by a control device 42. For operating the retaining devices 28*b* and 28*c*, the heater 72, the compressor 52, the expansion valve 54 and the like, the printing apparatus 12 is provided with a power source device and the like, or connected to the power source device and the like. The expansion valve 54 is provided with an actuator for adjusting an opening thereof and is controlled to a given opening by controlling the actuator.

Here, the heat exchange and the removal of the ink solvent in the ink drying apparatus 10 will be explained. As described above, in FIG. 2, the coolant flows in the coolant passage 50 in a clockwise direction and the gas flows in the gas passage 46 in a clockwise direction. The flow of the coolant in the coolant passage 50 is caused by the operations of the compressor 52 and the expansion valve 54, and the flow of the gas in the gas passage 46 is caused by the operation of the blower fan 48.

The coolant is compressed by the compressor 52 to become in a high-temperature and high-pressure state, which flows in the first coolant passage 58 and is depressurized by the expansion valve 54. The coolant which has been low in temperature and low in pressure by the depressurizing flows in the second coolant passage 64 toward the compressor 52 and is compressed by the compressor 52.

The heat of the high-temperature coolant flowing in the first coolant passage 58 is released by the radiator 60. Thereby the gas in the gas passage 46 is heated through the first fin 62 in the radiator 60. In this way, the heat exchange between the coolant flowing in the first coolant passage 58 and the gas flowing in the gas passage 46 is performed.

The high-temperature gas heated by passing through the radiator 60 flows in the gas passage 46 in such a manner to flow on the carrying belt 24 in the carrying unit 22. This means that in a case where the printed material 14 exists on the carrying belt 24, the gas flows in the periphery of the printed material 14. This promotes evaporation (including vaporization) of the solvent in the ink attached to the printed material 14 placed on the carrying belt 24. In this way, the drying of the ink attached to the printed material 14 is promoted, enabling the ink to be quickly settled onto the printed material 14.

Since the gas which has passed on the printed material 14 contains the gaseous solvent, it has a high temperature and a high humidification. The gas of a high temperature and a high humidification passes through the endothermic device 68 having the second fins 66. The endothermic device 68 is arranged in the second coolant passage 64 in which the coolant of a low temperature and a low pressure flows and therefore is low in temperature. Therefore, the gas of a high temperature and a high humidification is cooled by passing through the endothermic device 68. As a result, it is possible to condense the gaseous solvent in the periphery of the second fins of the endothermic device 68. That is, by passing through the endothermic device 68, it is possible to convert the gas of a high temperature and a high humidification into the gas of a low temperature and in a dried state. It should be noted that the heat absorbed from the gas in the endothermic device 68 transfers to the coolant. As a result, the heat can move between the radiator 60 and the endothermic device 68.

The dried gas of a low temperature is, as described above, heated in the radiator 60 once more to be converted into the dried gas of a high temperature, which is used for drying out the ink. It should be noted that a droplet of the solvent condensed in the periphery of the second fin 66 in the endothermic device 68, for example, the solvent attached to the second fin 66 is discharged outside of the gas passage 46 by the solvent discharging device 70.

In this way, in the ink drying apparatus in the first embodiment, the heat pump device 56 is used as the heat source. The radiator 60 as a part of the heating unit and the endothermic device 68 as a part of the cooling unit included in the solvent removing unit are associated with each other such that the heat can transfer from the endothermic device 68 to the radiator 60 through the cooling passage 50 in the heat pump device 56 as the heat transmission unit. That is, the heating unit and the solvent removing unit are associated with each other such that the heat can transfer from the solvent removing unit to the heating unit through the heat transmission unit. In addition, the gas passage is circularly formed such that the gas can be re-circulated therein.

In view of a systematical arrangement of the apparatus in the present embodiment, the apparatus is provided with a heat pump system having the circular coolant passage provided with the compressor and the expansion mechanism unit. The heating unit and the cooling unit are arranged in the circular coolant passage in the heat pump. In the heat pump system, the heating unit is heated and the cooling unit is cooled. A part of the heat transmitted from the gas in the gas passage to the cooling unit is returned back to the heating unit through the heat transmission unit as a part of the coolant passage.

Next, a drying control of ink in the ink drying apparatus 10 of the printing apparatus 12 will be explained with reference to a flow chart in FIG. 4. However, hereinafter, the solvent contained in the ink is water. It should be noted that in the present invention, the solvent of the ink is not limited to the water. A feeding speed of the printed material 14 is constant.

The control device 40 including the control device 42 receives recorded data (containing image information (data)) as information such as the sheet number and a size of the printed material 14 from the transmitting unit 44, preferably also environment data as information such as temperature and humidity inside and outside of the printing apparatus 12. However, the sheet number of the printed material 14 means the number of the printed material 14 sequentially fed from the carrying unit 22 to the print unit 30 and the drying unit 32.

Since the infrared moisture meter 45 is provided for detecting a water component amount of the printed material 14, the control device 40 receives a signal corresponding to the water component amount from the infrared moisture meter 45. Further, the control device 40 receives a signal corresponding to a temperature of the radiator 60 from the temperature sensor 74. It should be noted that the control device 40 operates the print unit 30 based upon these data, the detection values and the like, and makes the print unit 30 eject a predetermined amount of predetermined ink toward a predetermined spot on the printed material 14.

The control device 42 calculates an ink amount (maximum ink amount) X at a location where the ink attachment amount per unit area is maximized in the printed material 14, based upon these data and the like or based upon the calculation result (data) for ink ejection by the print unit 30. In addition to it, the control device 42 calculates a water component amount W per unit area originally contained in the printed material 14. A sum of the maximum ink amount X and the water component amount W is calculated as a total water component amount C per unit area (step S401). For this calculation, the control device 42 uses various data and calculation expressions recorded and stored. It should be noted that here, the process is executed assuming that the ink amount is equal to a solvent amount contained in the ink, that is, a water component amount, but the solvent amount contained in the ink may be calculated from the ink amount.

In addition, an operation mode of the drying unit 32 in the ink drying apparatus 10 is selected. The operation mode is composed of five operation modes. The first mode does not substantially operate the ink drying apparatus 10, that is, is a mode for stopping the blower fan 48, the heat pump device 56 and the heater 72. The second mode is a mode for operating only the blower fan 48 (mode for operating the flow applying unit). The third mode is a mode for operating the blower fan 48 and the heater 72 (mode for operating the flow applying unit and the second heating unit). The fourth mode is a mode for operating the blower fan 48, the heater 72 and the heat pump device 56 (mode for operating the flow applying unit, the second heating unit, the heating unit and the solvent removing unit). The fifth mode is a mode for operating the blower fan 48 and the heat pump device 56 (mode for operating the flow applying unit, the heating unit and the solvent removing unit).

The selection of the operation mode is performed based upon the calculated total water component amount C, the detected temperature T of the radiator 60 and the sheet number N (sequential drying sheet number) of the printed material 14 sequentially fed to the drying unit 32.

First, it is determined whether or not the total water component amount C is larger than a first water component amount $\alpha$ (step S403). The first water component amount $\alpha$ is a boundary value between a water component amount which can dry out with natural drying alone without an operation of the ink drying apparatus 10 and a water component amount which can dry out with blowing air alone. It should be noted that the first water component amount $\alpha$ is larger than the water component amount W and larger than the lower limit water component amount required for holding a quality of the printed material 14 at a dried state, and is a water component amount in which an extra solvent can spontaneously vaporize for a period where the printed material 14 passes through the drying unit 32. Therefore, in a case where the total water component amount C is not larger than the first water component amount $\alpha$, that is, equal to or less than the first water component amount $\alpha$, the operation of the ink drying apparatus 10 is stopped and the ink on the printed material 14 naturally dries out (step S405). It should be noted that the first water component amount $\alpha$ is defined in advance based upon an experiment or the like for storing. However, the first water component amount $\alpha$ may be defined at each time by retrieving data recorded in advance based upon an experiment or the like or performing a predetermined calculation defined in advance, based upon a size, a thickness, a kind and the like of the printed material 14.

On the other hand, when the total water component amount C is larger than the first water component amount $\alpha$, it is determined whether or not the total water component amount C is larger than the second water component amount $\beta$ ($\beta>\alpha$) (step S407). The second water component amount $\beta$ is a boundary value between a water component amount which can dry out with blowing air alone and a water component amount requiring heating and drying. Therefore, when the total water component amount C is equal to or less than the second water component amount $\beta$, the blower fan 48 is operated, thereby applying a flow to the gas in the gas passage 46. As a result, the ink on the printed material 14 is dried out by blowing air (step S409). In a case where a flow speed of the gas by the blower fan 48 can be adjusted, the blower fan 48 may be adjusted such that the flow speed corresponds to the total water component amount C. The second water component amount $\beta$ is defined in advance based upon an experiment or the like and stored. However, the second water component amount $\beta$ may be defined at each time by retrieving data printed in advance based upon an experiment or the like or performing a predetermined calculation defined in advance, based upon an environment data or the like.

When the total water component amount C is larger than the second water component amount $\beta$, the printed material 14 is heated and dried out. However, some degree of time is required for activation (rising) of the heat pump device 56. Therefore, based upon a temperature of the radiator 60 (corresponding to a coolant temperature) and the sequential drying sheet number, any one of the operation modes composed of a heat drying mode using the heater 72, a heat drying mode using the heat pump device 56 and a heat drying mode using both of them is selected.

First, it is determined whether or not a temperature T of the radiator 60 is higher than a predetermined temperature $\gamma$ (step S411). The predetermined temperature $\gamma$ is defined in advance based upon an experiment or the like and stored, and is specifically defined in such a manner that it can be determined whether or not the heat pump device 56 is already activated.

When it is determined that the temperature T of the radiator 60 is equal to or less than the predetermined temperature $\gamma$, it is determined whether or not the sequential drying sheet number N is larger than a predetermined sheet number $\delta$ (step S413). The predetermined sheet number $\delta$ is defined in advance based upon an experiment or the like and stored, and specifically is the sheet number by which the drying of the printed material 14 can be completed by use of the heater 72 before waiting for the activation of the heat pump device 56. For example, the predetermined sheet number $\delta$ may be defined as 1 or 2.

When the temperature T of the radiator 60 is equal to or less than the predetermined temperature $\gamma$ and the sequential drying sheet number N is equal to or less than the predetermined sheet number $\delta$, the heater 72 and the blower fan 48 are operated so as to promote the drying of the ink on the printed material 14 (step S415).

On the other hand, when the temperature T of the radiator 60 is equal to or less than the predetermined temperature $\gamma$ and the sequential drying sheet number N is larger than the predetermined sheet number $\delta$, first, the heater 72 and the blower fan 48 are operated to promote the drying of the ink on the printed material 14. However, at this time, the heat pump device 56 is also operated (the compressor 52 is operated and the expansion valve 54 is opened to a predetermined value). In addition, when a temperature of the coolant in the heat pump device 56 reaches a predetermined temperature to activate the heat pump device 56 (when the temperature T of the radiator 60 reaches a temperature higher than the predetermined temperature γ), the heater 72 is stopped. As a result, the drying of the ink on the printed material 14 is promoted with operations of the heat pump device 56 and the blower fan 48 (step S417).

On the other hand, when the temperature T of the radiator 60 is higher than the predetermined temperature (in a case of a positive determination at step S411), since the heat pump device 56 is already activated, a hot gas generated by an operation of the heat pump device 56 is fed by the blower fan 48. In this way, the drying of the ink on the printed material 14 is promoted (step S419).

In this way, in the first embodiment, the heat pump device 56 is applied to the drying unit 32 in the ink drying apparatus 10. The radiator 60 constituting a part of the heating unit and the endothermic device 68 constituting a part of the solvent removing unit are associated with each other such that the heat can transfer from the solvent removing unit to the heating unit by the heat pump device 56. Accordingly by controlling the operation of the heat pump device 56 as needed, heating and dehumidification of the gas in the gas passage 46 are further performed without necessity of wasteful use of the energy. In this way, the ink of the printed material 14 can be quickly dried out with a good energy efficiency to be settled.

<Second Embodiment>

Next, an ink drying apparatus 100 according to the second embodiment in the present invention will be explained. In the ink drying apparatus 100, an electronic heat exchange device is applied instead of the heat pump device as a heat source. Other than this, the ink drying apparatus 100 has the arrangement substantially similar to that of the ink drying apparatus 10. Therefore, hereinafter, mainly the feature of the ink drying apparatus 100 which the ink drying apparatus 10 does not have will be explained. Elements as a part of the ink drying apparatus 100 which are the same or substantially the same as the elements mentioned above are referred to with the same reference numerals as or the reference numerals corresponding to those of the aforementioned elements, and an explanation thereof is omitted. However, the ink drying apparatus 100 is also applied to an ink-jet printing apparatus 112 similar to the ink-jet printing apparatus 12 to which the ink drying apparatus 10 is applied.

Figure 5:
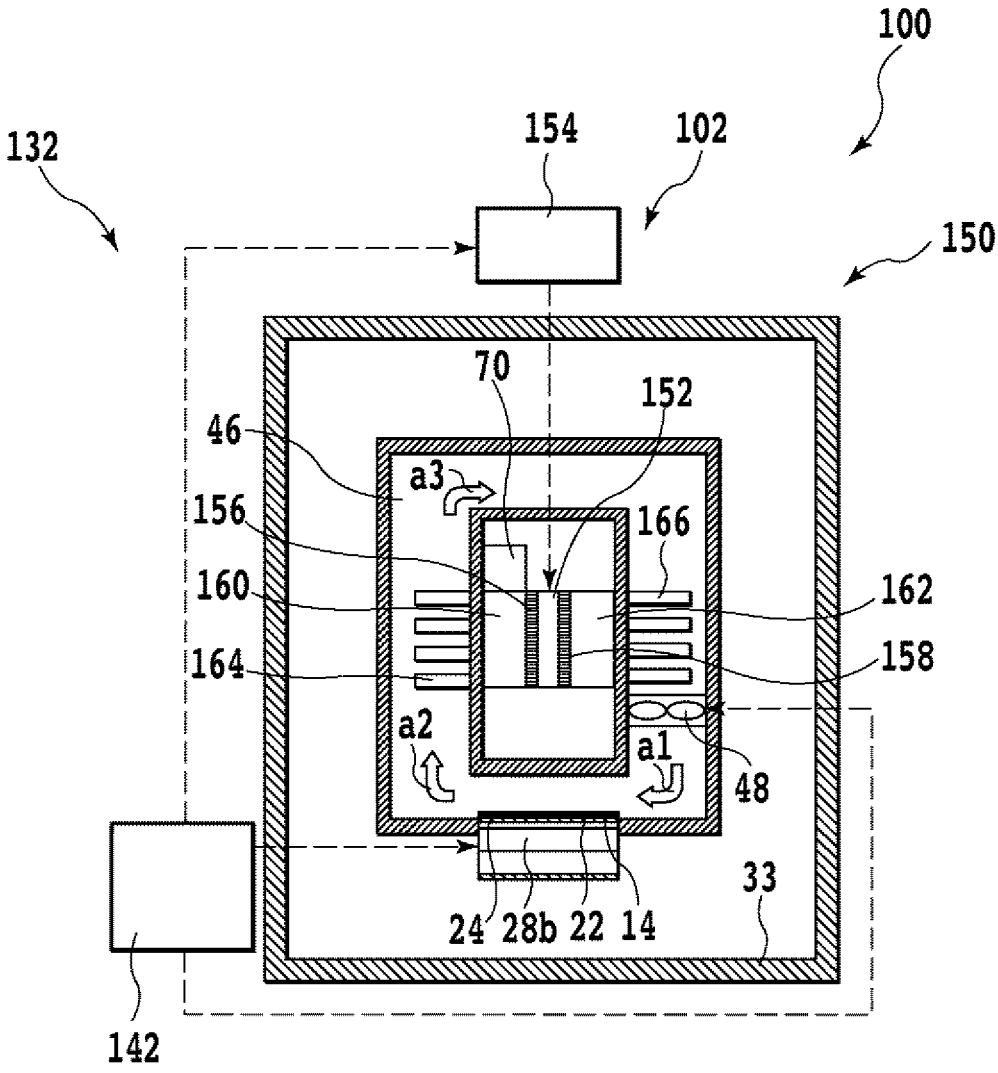
FIG. 5 is schematically a cross-sectional diagram showing an ink drying apparatus of a second embodiment and corresponding to a cross-section taken along line A-A in FIG. 1.

FIG. 5 shows a cross-sectional diagram of the ink drying apparatus 100. In the present second embodiment, an electronic heat exchange device 150 is applied to a drying unit 132. The electronic heat exchange device 150 as the heat transmission unit is provided with a Peltier device 152. The heating and dehumidification of the gas in the gas passage 46 are performed by adjusting a power amount supplied to the Peltier device 152. A control device 142 controls a power source device 154 in such a manner as to appropriately control the supply power amount to the Peltier device 152.

The Peltier device 152 in the electronic heat exchange device 150 is used as the heat source. When predetermined applied current is given to the Peltier device 152 from the power source device 154, one of two main surfaces in the Peltier device 152 acts as a cooling surface 156 and the other acts as a heat generating surface 158. By changing the applied current to the Peltier device 152, both temperatures of the cooling surface 156 and the heat generating surface 158 can be changed. The applied current to the Peltier device 152 is controlled by the control device 142.

A cooling fin unit 160 is connected to the cooling surface 156 of the Peltier device 152 and a heat-generating fin unit 162 is connected to the heat generating surface 158. The fins 164 and 166 of each of the cooling fin unit 160 and the heat-generating fin unit 162 are arranged to extend into the gas passage 46. It should be noted that a part of the Peltier device 152 and the cooling fin unit 160 are included in the cooling unit and a part of the Peltier device 152 and the heat-generating fin unit 162 are included in the heating unit.

The drying gas in the gas passage 46, here, air, is recirculated in the gas passage 46 in a predetermined direction with an operation of the blower fan 48 as the flow applying unit. The gas is cooled and dehumidified by the cooling fin unit 160. After that, the gas dried at a low temperature is heated by the heat-generating fin unit 162 to be converted into a high-temperature and low-humidity gas. The gas dried at a high temperature passes through the periphery of the printed material 14 on the carrying belt 24 of the carrying unit 22, and thereby evaporation (including vaporization) of the ink solvent in the printed material 14 is promoted to promote the drying of the ink. The gas which has reached a high temperature and high humidity by containing the gaseous solvent again leads to the cooling fin unit 160. In consequence, the gas of a high temperature and high humidity is converted into a gas of a low temperature and low humidity. It should be noted that the droplet of the solvent attached to the cooling fin unit 160 is discharged from the solvent discharging device 70.

It should be noted that a heater as the second heating unit is not provided in the drying unit 132 in the ink drying apparatus 100 of the second embodiment. However, the drying unit 132 may be likewise provided with the heater at a location similar to the arrangement location of the heater 72 in the drying unit 32.

As understood from the above explanation, in the second embodiment, the heating unit and the cooling unit as the solvent removing unit are connected through the Peltier device 152 as the heat transmission unit and associated with each other such that the heat can transfer from the solvent removing unit (cooling unit) to the heating unit. Therefore, the drying gas which has passed through the cooling fin unit 160 further flows in the gas passage 46 to be in contact with the heat-generating fin unit 162 and be heated, and at this time the heat transferring from the cooling fin unit 160 is used for heating the drying gas. In addition, power input to the Peltier device 152 is used for heating the drying air at the heat-generating fin unit 162. Accordingly, by using such electronic heat exchange device 150, the energy efficiency at heating and drying can be enhanced.

Next, a drying control of ink in the ink drying apparatus 100 of the printing apparatus 112 will be explained with reference to a flow chart in FIG. 6. However, hereinafter, the solvent contained in the ink is water. It should be noted that a feeding speed of the printed material 14 is constant.

Figure 4:
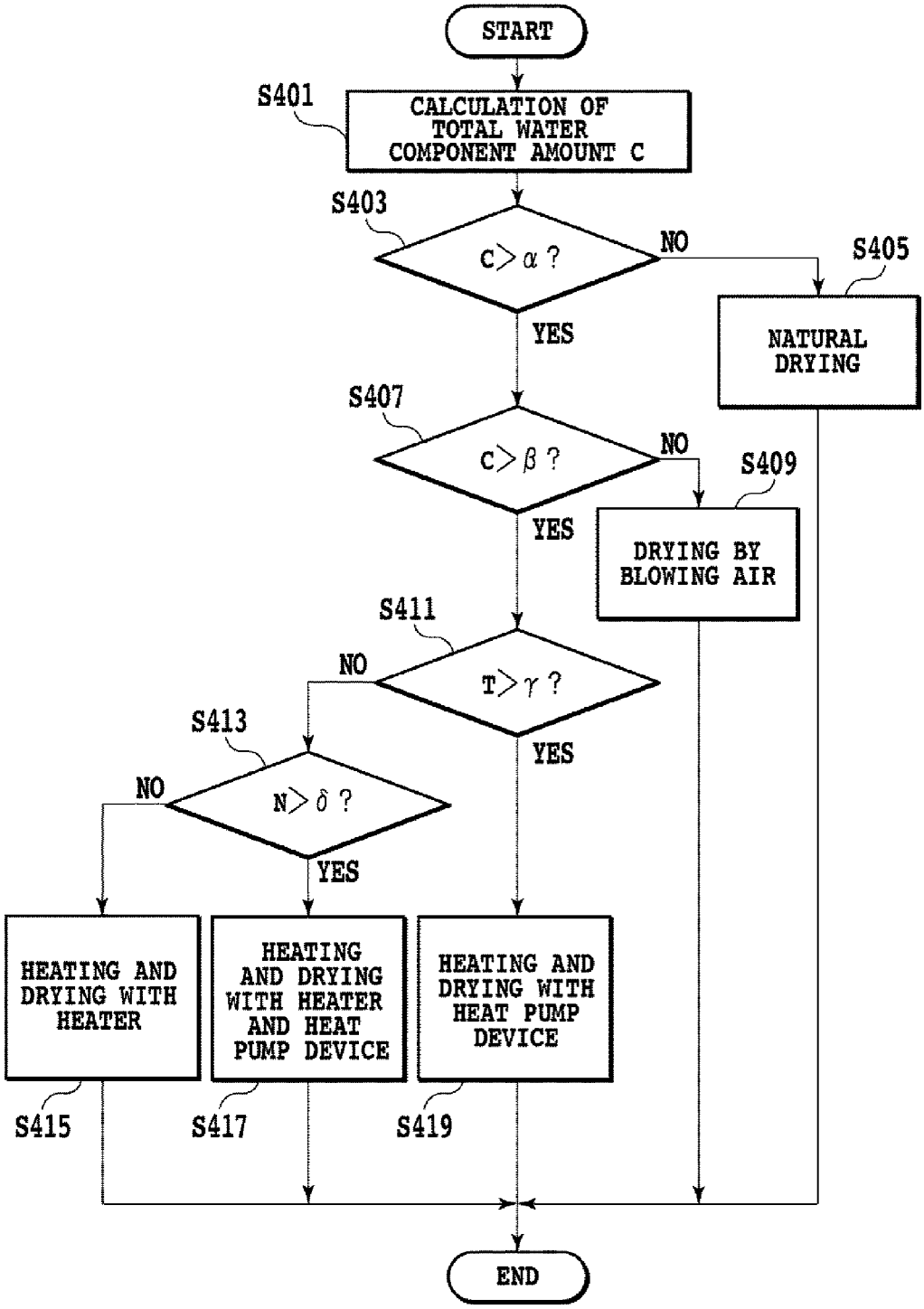
FIG. 4 is a flow chart in regard to the ink drying apparatus of the first embodiment.
Figure 6:
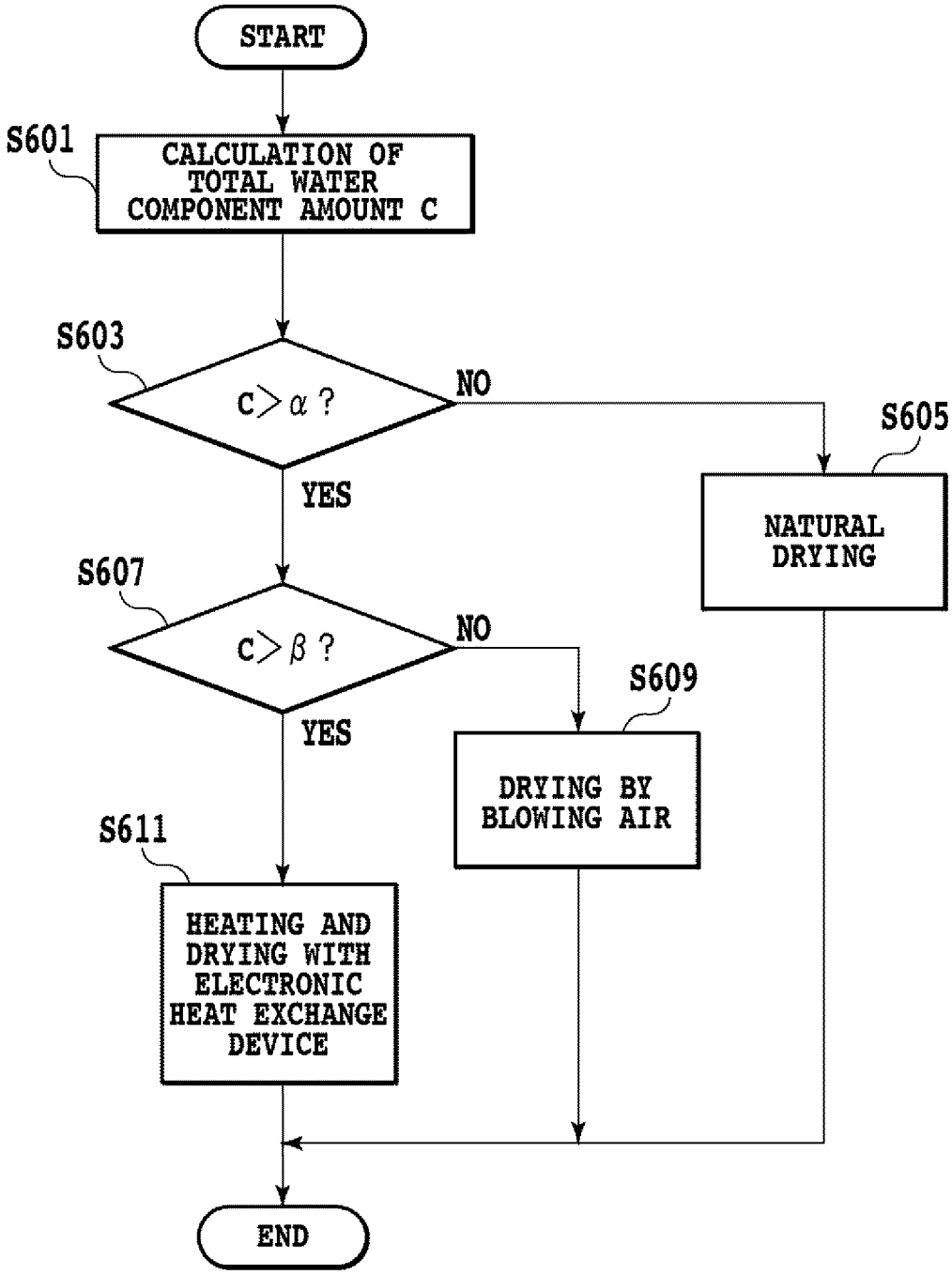
FIG. 6 is a flow chart in regard to the ink drying apparatus of the second embodiment.

Steps S601 to S609 in FIG. 6 respectively correspond to steps S401 to S409 in FIG. 4 described above. Therefore, a detailed explanation of steps S 601 to S609 is omitted.

First, there is calculated a total water component amount C per unit area which is a sum of a maximum ink amount X at a location where the ink attachment amount per unit area is maximized in the printed material 14 and a water component amount W per unit area originally contained in the printed material 14 (step S601).

It is determined whether or not the total water component amount C is larger than a first water component amount α (step S603). When the total water component amount C is equal to or less than the first water component amount α, the operation of the ink drying apparatus 100 is stopped, and the ink on the printed material 14 naturally dries out (step S605).

On the other hand, when the total water component amount C is larger than the first water component amount α, it is then determined whether or not the total water component amount C is larger than a second water component amount β(β>α) (step S607). When the total water component amount C is larger than the first water component amount α and equal to or less than the second water component amount β, the blower fan 48 is operated without operating the electronic heat exchange device 150. As a result, the ink on the printed material 14 is dried out by blowing air (step S609).

When the total water component amount C is larger than the second water component amount β, the electronic heat exchange device 150 is operated and also the blower fan 48 is operated, thereby heating and drying out the ink on the printed material 14 (step S611). The supply power amount to the electronic heat exchange device 150 is adjusted based upon the total water component amount C. Specifically, by retrieving data defined in advance by an experiment or the like and stored or performing a calculation defined in advance based upon the total water component C, the power amount is defined at each time.

In the above description, the present invention is explained based upon the two embodiments and the modifications, but the present invention allows other embodiments. For example, the feeding speed of the printed material 14 may vary in the drying unit 32 or 132. In this case, the feeding speed of the printed material 14 may vary based upon the total water component amount C, the sequential drying sheet number or the like. For example, when a value C' found by dividing the total water component amount C by unit time is compared with a value α' found by dividing the first water component amount a by unit time and a value β' found by dividing the second water component amount β by unit time, one feeding speed out of the various feeding speeds is selected. Specifically, when the total water component amount C or C' is equal to or less than the predetermined value α or α', since the drying by the drying unit 32 or 132 is substantially unnecessary, the feeding speed is maximized. Further, when the total water component amount C or C' is larger than the predetermined value β or β', the feeding speed of the printed material 14 is delayed from the reference speed corresponding to the water component amount.

The present invention allows other embodiments by entirely or partially combining an entirety or a part of the two embodiments with the modifications. These can be combined with each other within the scope of non-contradiction.

It should be noted that in the above embodiments and the modifications, the present invention is explained in detail to a certain degree, but it should be understood that various changes or modifications can be made within the spirit or the scope of the invention claimed in the claims. That is, the present invention includes changes and modifications included in the scope and the spirit of the claims and its equivalents.

This application claims the benefit of Japanese Patent Application No. 2009-129209, filed May 28, 2009, which is hereby incorporated by reference herein in its entirety.

The invention claimed is:

1. An ink drying apparatus comprising:

a gas passage which is circulatingly defined and is configured such that a gas can be circulated in the gas passage, wherein a printed material passes through a part of the gas passage;

a fan to form a flow of the gas such that the gas in the gas passage flows in a given direction for circulation;

a heater to heat the gas in the gas passage, the heater being provided upstream of the part of the gas passage through which the printed material passes;

a radiator to which a radiating part is connected, the radiating part being exposed to an inside of the gas passage to heat the gas in the gas passage, the radiator being provided upstream of the part of the gas passage through which the printed material passes; and an endothermic device to which a cooling part is connected, the cooling part being exposed to an inside of the gas passage to cool the gas in the gas passage, thereby condensing an ink solvent, the endothermic device being provided downstream of the part of the gas passage through which the printed material passes and upstream of the radiating part, wherein the radiator and the endothermic device are associated with each other such that heat can be transferred therebetween by a heat pump system having a compressor and an expansion valve, wherein the heat pump system comprises a circulating coolant passage, in which the radiator, the expansion valve, the endothermic device and the compressor are arranged in the listed order along a direction of a coolant flow in the coolant passage, wherein when the heat pump system is operated by driving the compressor and the expansion valve, the radiator is heated by the coolant in a high-temperature and high-pressure state, which has passed through the compressor, to result in a part of the heat transmitted from the radiator to the radiating part and the endothermic device being cooled by the coolant in a low-temperature and low-pressure state, which has passed through the expansion valve, to result in a part of the heat transmitted from the cooling part to the endothermic device, and a part of the heat transmitted to the endothermic device is transmitted to the coolant flowing in the coolant passage, thereby to be returned back to the radiator, and wherein the gas heated by the heater and the radiating part promotes the drying of the ink attached to the printed material, and then the ink solvent generated by the drying is condensed in the cooling part.

2. The ink drying apparatus according to claim 1, further comprising a discharging unit to discharge the ink solvent condensed in the cooling part out of the gas passage.

3. The ink drying apparatus according to claim 2, wherein the cooling part, the endothermic device and the discharging unit are provided integrally.

4. The ink drying apparatus according to claim 1, further comprising a control unit for controlling the heat pump system, the fan and the heater based upon an amount of ink applied to the printed material.

5. An ink jet printing apparatus provided with the ink drying apparatus according to claim 1.

* * * * *